United States Patent [19]

IIzuka et al.

[11] Patent Number: 4,768,469

[45] Date of Patent: Sep. 6, 1988

[54] OPERATION CONTROL APPARATUS FOR RECOVERY BOILERS

[75] Inventors: Kazuyuki IIzuka; Tsuguo Kumaki; Ryuichi Kuwata; Iwao Chikahisa, all of Tokyo; Yoshikazu Fukushima; Youhei Shiokoshi, both of Yatsushiro; Takao Matsuda, Oosaka; Masaru Nishimura, Kobe; Takashi Tanihara, Nara; Yoshimitsu Kurosaki, Kakogawa; Toshiyuki Itoko, Ashiya; Shirou Nakabayashi, Kobe, all of Japan

[73] Assignee: Kabushiki Kaisha Toshiba, Kawasaki, Japan

[21] Appl. No.: 90,425

[22] Filed: Aug. 26, 1987

Related U.S. Application Data

[63] Continuation of Ser. No. 891,179, Jul. 31, 1986, abandoned.

[30] Foreign Application Priority Data

| | | | |
|---|---|---|---|
| Jul. 31, 1985 | [JP] | Japan | 60-168996 |
| Jul. 31, 1985 | [JP] | Japan | 60-168997 |
| Jul. 31, 1985 | [JP] | Japan | 60-168998 |
| Jul. 31, 1985 | [JP] | Japan | 60-168999 |
| Jul. 31, 1985 | [JP] | Japan | 60-169000 |
| Jul. 31, 1985 | [JP] | Japan | 60-169001 |
| Jul. 31, 1985 | [JP] | Japan | 60-169002 |
| Jul. 31, 1985 | [JP] | Japan | 60-169003 |
| Aug. 1, 1985 | [JP] | Japan | 60-170031 |

[51] Int. Cl.[4] ..... F23N 5/00

[52] U.S. Cl. ..... 122/448 R; 110/101 CD; 122/7 C; 236/14; 236/15 E

[58] Field of Search ..... 122/7 C, 379, 446, 44 BR, 122/451 R, 451 S, 451.1, 451.2, 452; 236/15 BD, 15 E, 15 BB, 14, 25 R, 25 A; 431/12, 76, 89; 162/30.1, 47; 73/23; 374/124, 127; 110/101 R, 101 CD

[56] References Cited

U.S. PATENT DOCUMENTS

| | | | |
|---|---|---|---|
| 3,607,117 | 9/1971 | Shaw et al. | 122/44 BR X |
| 3,625,186 | 12/1971 | Herbst | 122/7 C |
| 3,703,919 | 11/1972 | Owens et al. | 122/7 C X |
| 3,847,092 | 11/1974 | Gilbert | 122/7 C X |
| 3,877,636 | 4/1975 | Sato | 122/44 BR X |
| 3,908,897 | 9/1975 | Von Holtz et al. | 122/44 BR X |
| 3,993,447 | 11/1976 | Buss et al. | 236/15 E X |
| 4,015,548 | 4/1977 | Schuss | 122/44 BR X |
| 4,262,843 | 4/1981 | Omori et al. | 236/15 E X |
| 4,359,950 | 11/1982 | Leffler et al. | 236/15 E X |
| 4,363,698 | 12/1982 | Nelson et al. | 162/30.1 |
| 4,498,428 | 2/1985 | La Spisa et al. | 122/44 BR |
| 4,539,588 | 9/1985 | Ariessohn et al. | 374/127 X |
| 4,552,098 | 11/1985 | Wynnyckyj et al. | 122/379 |
| 4,574,746 | 3/1986 | Keyes, IV et al. | 236/14 X |

FOREIGN PATENT DOCUMENTS

| | | |
|---|---|---|
| 1200055 | 2/1986 | Canada . |
| 64409 | 7/1983 | Finland . |

*Primary Examiner*—Steven E. Warner

*Attorney, Agent, or Firm*—Oblon, Fisher, Spivak, McClelland & Maier

[57] ABSTRACT

An apparatus for controlling operation of a recovery boiler for compensating a predetermined reference temperature of black liquor by a compensation value in accordance with a type of an injecting gun provided in the boiler, a compensation value set by the properties of the black liquor, a compensation value set by the temperature of charbed and a compensation value set by an air flow rate to the boiler representing the magnitude of boiler steam output or load to control the black liquor temperature supplied to the boiler.

6 Claims, 9 Drawing Sheets

FIG. 16
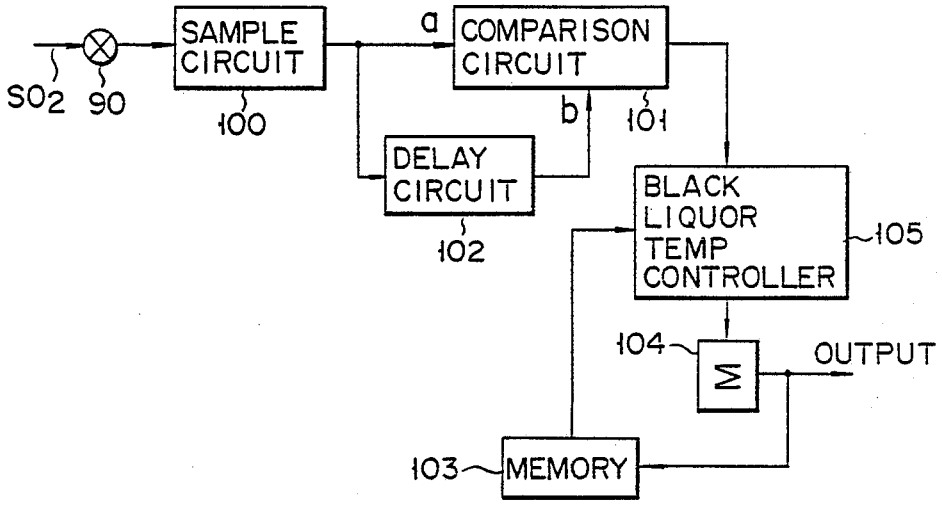
FIG. 17
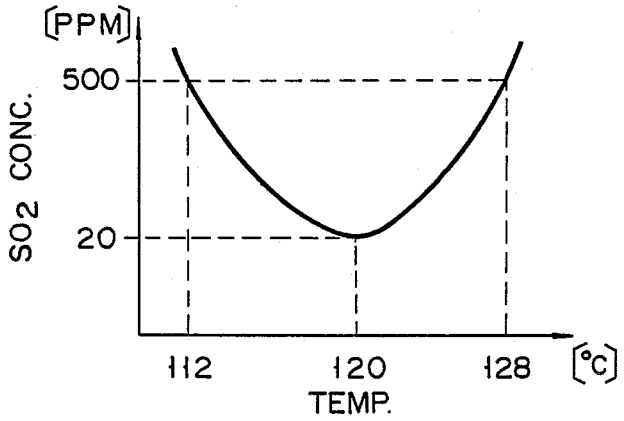
FIG. 18
| a - b | PRECEDING DATA | PRESENT DATA |
|---|---|---|
| + | + | − |
| | − | + |
| − | + | + |
| | − | − |

OPERATION CONTROL APPARATUS FOR RECOVERY BOILERS

This application is a continuation of application Ser. No. 891,179, filed on July 31, 1986, now abandoned.

BACKGROUND OF THE INVENTION

The present invention relates to an operation control apparatus for recovery boilers in which black liquor produced in a pulp production process is treated to obtain smelted sodium sulfide $Na_2S$ and high temperature steam.

Black liquor is produced as a waste liquor from a chip cooking step in the pulp production process. The black liquor contains sodium sulfate $Na_2SO_4$ produced from inorganic matter such as sodium hydroxide NaOH used as chip cooking liquor and organic matter such as lignin included in the chip. When such a black liquor is heated and injected into a recovery boiler, the organic matter is burnt to recover a material for the cooking liquor and high temperature steam is simultaneously obtained as the output of the boiler. More particularly, when the black liquor is injected into the boiler, the droplet of the black liquor is dried while dropping in the boiler, and it is deposited as charbed on the bottom of the boiler furnace. When the charbed is burnt, a deoxidization reaction occurs to convert sodium sulfate $Na_2SO_4$ contained in the charbed into sodium sulfide $Na_2S$, thereby recovering the smelted $Na_2S$ from the bottom of the boiler furnace into the exterior and simultaneously generating a large quantity of high temperature steam to output it from the boiler.

In order to stably operate such a recovery boiler, it is understood to necessitate the controls of a number of factors such as the temperature and the pressure of the black liquor, the flow rate of air blown into the boiler, the depositing height of the charbed in the boiler, and the temperature distribution of the surface. Further, sulfur dioxide $SO_2$ is contained in the gas exhausted from the recovery boiler, and it is also understood that there is a correlation between the boiler operating state and the concentration of the sulfur dioxide.

For example, if the diameter of the black liquor droplet increases due to a temperature or pressure drop of the black liquor or to an increase of the concentration of the liquor, the water content of the charbed increases causing the burning temperature of the charbed to decrease, and the deoxidization reaction of the sodium sulfide is disturbed. Further, the charbed abnormally increases in size to collapse and disturb the stable burning of the charbed.

On the contrary, if the diameter of the black liquor droplet decreases due to the temperature or pressure rise of the black liquor or due to the decrease of the black liquor concentration, it is burnt before depositing on the bottom of the boiler, then a very fine dust will be formed without the charbed being formed, and the deoxidization reaction of the sodium sulfide might not preferably take place.

SUMMARY OF THE INVENTION

It is an object of the present invention to provide an operation control apparatus for recovery boilers which is capable of always maintaining a stable burning state and high cooking liquor material recovery rate in response to a load change of the boiler irrespective of the physical, chemical, and property changes such as composition, temperature, and concentration of the black liquor.

In an operation control apparatus for recovery boilers according to the present invention, a predetermined reference temperature of the black liquor is compensated by at least one of a temperature compensation values decided by the concentration and the physical properties of the black liquor, a temperature compensation value decided by the black liquor injecting gun shape and the black liquor pressure, a temperature compensation value decided by the state of charbed, a temperature compensation value decided by a boiler load, and a temperature compensation value decided by an amount of $SO_2$ in an exhausted gas; and the black liquor is heated by the initially set temperature thus compensated. Since the black liquor temperature is thus controlled, the stable burning state of the boiler and high recovery rate of material of black liquor can be realized.

BRIEF DESCRIPTION OF THE DRAWINGS

FIG. 16 is a block diagram of the construction for searching the temperature illustrating that the concentration of the sulfur dioxide becomes minimum with respect to the black liquor temperature;

FIG. 17 is a graph showing a relationship between the black liquor temperature and the concentration of the sulfur dioxide obtained by the construction in FIG. 16; and FIG. 18 is a view for describing the operation of the circuit in FIG. 16.

DETAILED DESCRIPTION OF THE PREFERRED EMBODIMENTS

The present invention will now be described in more detail with reference to the accompanying drawings.

Figure 1:
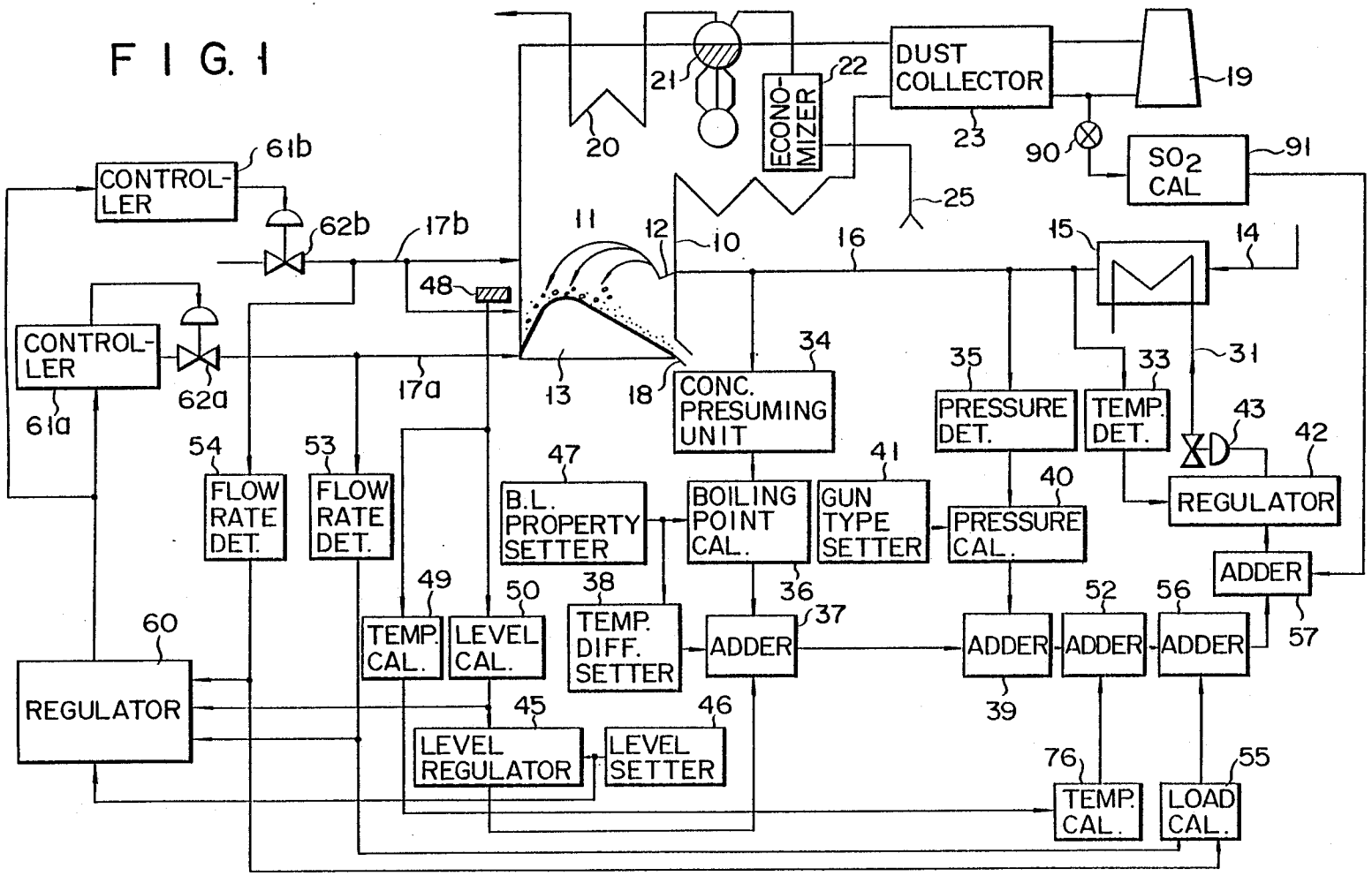
FIG. 1 is a block diagram showing the construction of an embodiment of the entire operation control apparatus according to the present invention.

In FIG. 1, injecting gun 12 for injecting the black liquor 11 is provided at the side wall of the cylindrical recovery boiler 10. Black liquor injected from gun 12 becomes a droplet having a diameter determined by the configuration of gun 12, and the temperature, the concentration, and the pressure of black liquor 11, drops in boiler 10 to be dried to become charbed 13, and is accumulated on the bottom of the furnace of boiler 10.

Black liquor 11 contains a large quantity of lignin of organic matter in waste liquor remaining after separating cellulose by cooking the chip with sodium hydroxide. The black liquor 11 fed through pipe 14 is heated to a predetermined temperature by heater 15, and then fed through pipe 16 to boiler 10. Black liquor 11 further contains inorganic components such as sodium sulfate $Na_2SO_4$ or sodium carbonate $Na_2CO_3$.

When black liquor 11 is injected into boiler 10, air is simultaneously blown from the bottom and the upper peripheral wall of boiler 10 through pipes 17*a* and 17*b* into boiler 10. As a result, organic matter such as lignin in charbed 13 is burnt, while a deoxidization reaction occurs therein so that smelted sodium sulfide called "smelt" is accumulated on the bottom of boiler 10, and flows out externally from outlet 18.

As charbed 13 is burned, high temperature combustion exhaust gas is generated in boiler 10. This gas is intaken to a chimney, but is thermally exchanged through superheater 20, drum 21, and economizer 22 provided in the midway, and is exhausted through electric dust collector 23 out of chimney 19.

Water is supplied through external pipe 25 into economizer 22, hot water is further heated by the bank tube of drum 21 to generate steam. This steam is further overheated by superheater 20 into superheated steam, which is supplied to a steam turbine generator.

Sulfur dioxide $SO_2$ gas generated upon thermal decomposition of sodium sulfate $Na_2SO_4$ in black liquor 11 and combustion of black liquid 11 is mostly reduced into sodium $Na_2$ gas or sodium sulfide $Na_2S$ generated at the top of charbed 13, but small part is exhausted from chimney 19. The concentration of the exhausting sulfur dioxide gas has a close relation to the operating conditions of boiler 10, and can be suppressed to the minimum by the suitable control. This will be described in more detail later.

In FIG. 1, temperature detector 33 for detecting the temperature of injected black liquor 11, solid content concentration presuming unit 34 for presuming the solid content concentration to become a function of the refractive index of black liquor solution by an optical refraction type concentration meter, and pressure detector 35 for detecting the injecting pressure are provided at the injected black liquor supply line 16. The output terminal of presuming unit 34 is connected to boiling point calculator 36. When calculator 36 calculates a boiling point from the solid content concentration, it presets a functional relation between the solid content concentration and the boiling point of the properties of the black liquor obtained in accordance with the type of the chip material 19 and presumes the boiling point from which the solid content concentration presumed by presuming unit 34 in accordance with the properties of the black liquor set in the black liquor property setter 47. The black liquor property is mainly determined by types of chips such as eucalyptus and broadleaf trees and an additional rate of cooking reagent. Further, temperature setter 38 sets a predetermined temperature difference in accordance with the properties of the black liquor set by setter 47, and adds the boiling point presumed and calculated by calculator 36 and the temperature difference set by a temperature difference setter 38 by first adder 37. Thus, even if the properties of the black liquor change by the type of the chip material 19 introduced into the chip cooking step, black liquor temperature set value obtained by suitable droplet diameter can be accurately calculated. The output terminal of adder 37 is connected to second adder 39.

On the other hand, the output terminal of pressure detector 35 is connected to one input terminal of pressure compensation value calculator 40, and injecting gun type setter 41 is connected to the other input terminal of calculator 40. Calculator 40 sets functions of calculating in advance a pressure compensation value in response to the types of the guns, selects the function in response to the type (diameter and shape) of the gun set by setter 41, and calculates the pressure compensation value according to the injecting pressure value detected by detector 35 in accordance with the selected function, and is connected at the output terminal to adder 39.

Adder 39 adds the black liquor temperature set value applied from adder 37 and the pressure compensation value applied from calculator 40 to compensate the black liquor temperature set value, is connected at the output terminal to one input terminal of temperature regulator 42, and detector 33 is connected to the other input terminal of regulator 42. Regulator 42 so regulates the opening of steam control valve 43 that the temperature of injected black liquor 11 detected by detector 33 becomes the black liquor temperature set value compensated by adders 52, 56 by the value calculated by adder 39 to the temperature of the boiler furnace and the load. This will be further described in more detail later. The quantity of steam 31 supplied to heater 15 is regulated in response to the opening of valve 43, and the temperature of injected black liquor heated by heater 15 is controlled.

In case of introducing chip cooking reagent and the chip material into a chip cooking oven or a digester, black liquor property setter 47 sets the properties of the black liquor obtained in accordance with the type of the chip material or the quantity of the chip cooking reagent. Thus, a boiling point calculator 36 presumes to calculate the boiling point of black liquor 11 from the properties of the black liquor thus set and the solid content concentration presumed by presuming unit 34.

Figure 2:
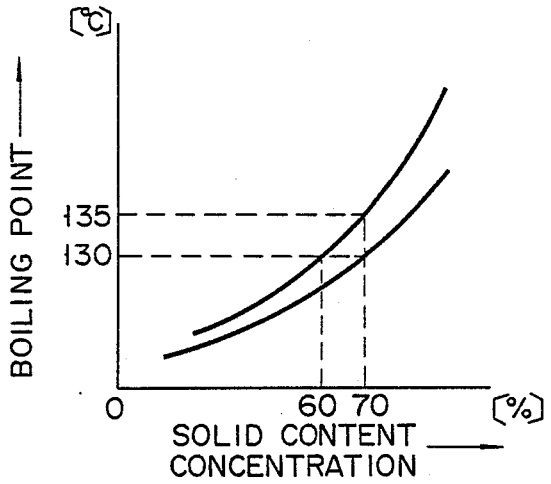
FIG. 2 is a graph showing a relationship between the solid content concentration and the boiling point of black liquor with the physical properties of the black liquor mainly determined by the types of chips as parameters.

Curve (a) in FIG. 2 is a view showing a relationship between the solid content concentration (an abscissa axis) and a boiling point (an ordinate axis) of eucalyptus bleaching pulp black liquor, and (b) in FIG. 2 is a view showing a relationship between the solid content concentration (an abscissa axis) and a boiling point (an ordinate axis) of a broadleaf tree material bleaching pulp black liquor. The functional relationships shown by curves (a) and (b) are set in advance in a table of a ROM in calculator 36. For instance, when the eucalyptus bleaching pulp black liquor is set in setter 47, calculator 36 selects the functional relationship shown in (a) and the solid content concentration presumed by the presuming unit 34 is S1(=70%), boiling point f1(=130° C.) is presumed to be calculated.

On the other hand, setter 38 sets the temperature difference from the boiling point to obtain a suitable diameter of a droplet in response to the properties of the black liquor set by setter 47, and outputs it to adder 37. Adder 37 calculates and outputs black liquor temperature set value lower by the temperature difference set by setter 48 than the boiling point calculated by calculator 36.

As described above, since the boiling point is presumed by the relationship between the solid content concentration and the boiling point of injected black liquor 11 for the various properties of a given black liquor, the variations in the boiling points of the black liquor 11 upon changes of the properties of the black liquor can be compensated therefor. Thus the variations in the black liquor temperature set value according to the variations in the boiling points can be easily compensated for, and the temperature of black liquor 11 can be always set to the temperature for providing the optimum diameter for the droplet. As a result, boiler 10 is always operated in an optimum combustion state to save and stabilize the pulp production process.

In case of exchanging gun 12 in response to the variation in the steam amount generated by boiler 10, setter 41 sets the type of gun 12. Then, calculator 40 selects a function of calculating the pressure compensation value in response to the injecting gun thus set from the ROM table, and calculates the pressure compensation value in accordance with the selected function and the injecting pressure value detected by detector 35.

Figure 3:
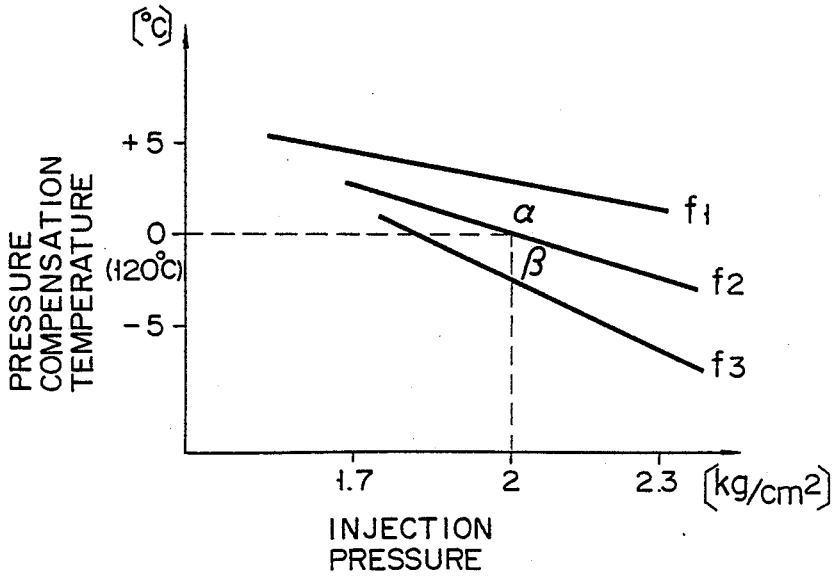
FIG. 3 is a graph showing a relationship between an injecting pressure and a compensated temperature difference with the type of injecting gun used for injecting the black liquor as a parameter.

FIG. 3 is a view showing a functional relationship between the injecting pressure responsive to the type of various injecting guns (three types in this embodiment) and the pressure compensation value. Curve f1 shows a functional relationship to gradually decrease the set temperature calculated by adder 39 upon rise of the injecting pressure, curve f2 shows a functional relationship to intermediately decrease the set temperature upon rise of the injecting pressure, and curve f3 shows a functional relationship to largely decrease the set temperature upon rise of the injecting pressure. These relationships are stored, for example, in a ROM table. When setter 41 sets the type of gun 12, the functional relationship is read out in response to the type of the gun, and the pressure compensation value is calculated by the injecting pressure detected by detector 35 in accordance with the relationship.

Assume now that gun 12 is exchanged from the gun having characteristic of f2 to that having characteristic of f3. Here, when the injecting pressure detected by detector 35 varies from P1 to P2, the conventional pressure compensating means calculates $\alpha$ as the pressure compensation value, while detector 40 of this embodiment calculates $\beta$.

On the other hand, adder 37 calculates the black liquor temperature set value lower by a predetermined temperature set by setter 38 than the boiling point of black liquor 11 presumed and calculated by calculator 36, and applies it to adder 39. Then, adder 39 adds the black liquor temperature set value and the pressure compensation value calculated by calculator 40, and calculates the black liquor temperature set value compensated by the injecting pressure. Then, the compensated black liquor temperature set value is output to next adder 52.

In FIG. 1, first and second air flow rate detectors 53 and 54 respectively detect the air flow rates of combustion air 17*a* and 17*b* supplied to boiler 10, and are connected at the output terminals to a load compensation value calculator 55. Calculator 55 calculates the load compensation value for compensating the black liquor temperature set value in accordance with the air flow rates detected by detectors 53 and 54, and is connected at its output terminal to adder 56.

Adder 56 adds the black liquor temperature set value applied from adder 62 and the load compensation value applied from calculator 55 to compensate the black liquor temperature set value, and is connected at its output terminal to in input terminal of regulator 42 through an adder 57, and detector 33 is connected to the other input terminal of regulator 42.

In the arrangement described above, the air flow rates of combustion air 17*a* and 17*b* supplied to the bottom and the center of the furnace in boiler 10 are respectively detected by detectors 53 and 54. Thus, calculator 55 calculates the load compensation value in accordance with the air flow rates detected by detectors 53 and 54.

Figure 4:
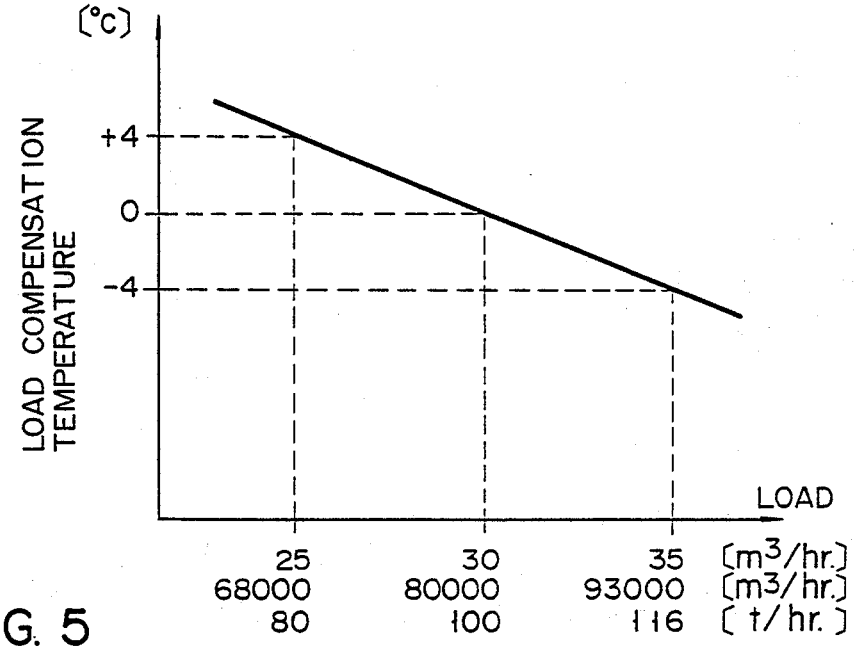
FIG. 4 is a graph showing a relationship between a boiler load represented by a flow rate of air flowed into the boiler and a compensated temperature difference.

FIG. 4 is a view showing a relationship between an air flow rate (load) and a load compensation value. In the case of the load reference value P of air flow rate such as 80,000 $m^3$/hr, the load compensation value is set to 0° C. At this time, the black liquor flow rate is, for example, 30 $m^3$/hr. When the air flow rate increases to 93,000 $m^3$/hr, i.e., the load increases, and the floating time of the droplet is lengthened. Thus, calculator 55 calculates the load compensation value to reduce the black liquor temperature set value calculated by adder 52. On the other hand, when the air flow rate decreases to 68,000 $m^3$/hr, i.e., the load decreases, and the floating time is shortened. Thus, the calculator 55 calculates the load compensation value to increase the black liquor temperature set value.

The black liquor temperature set value is initially set, for example, to 120° C. by regulator 42, which is compensated by adders 37, 39, 52, 56, 57 to the respective predetermined compensation values. Here, an example of temperature compensation by adder 52 and an example of temperature compensation by adder 37 will be described.

In FIG. 1, detector 48 for detecting the temperature in the furnace of boiler 10 and detecting a charbed level, which uses a radiation thermometer. Charbed level calculator 50 is connected to the output terminal of thermometer 48. The output of adder 50 is connected to black liquor temperature charbed level regulator 45 and combustion air charbed level regulator 60. Regulators 45 and 60 may employ the same set value or different set values by considering the contribution rate of the charbed level in the black liquor temperature and the combustion air. In any case, regulators 45 and 60 respectively compare the charbed level from calculator 50 with the set value from setter 46 to produce operation outputs so that the deviation becomes zero, and supply the operation outputs as the set values to adder 37 for regulating the black liquor temperature or regulator 60. Regulator 45 calculates the compensation output so that the black liquor temperature detected by detector 33 approaches the set value from setter 46. Regulator 60 calculates thereby producing an operation output so that the air flow rates detected by detectors 53, 54 approach the set value from setter 46 to control air blow controllers 61*a* and 61*b*, thusly controlling the openings of pneumatic values 62*a* and 62*b*.

The operation of the apparatus constructed as described above will be described. The reason for varying the level of charbed 14 by the temperature control of black liquor 11 is as described above, but the flow rate of black liquor 11 injected from gun 12 is constant, and the level of the charbed cannot be largely and abruptly varied.

On the contrary, the combustion air flow rate to boiler 10 is controlled for the purpose of directly accelerating the combustion, and the level of charbed 13 can be largely varied. In the apparatus shown in FIG. 1, regulators 45 and 60 are individually provided, compare the charbed level detected by detector 50 with the respective set values to produce operation outputs so that the deviations become zero. The regulators 45 and 60 supply the outputs as set values to regulators 45 and 60, and calculate the operation outputs so that the deviations between the black liquor temperatures detected by detectors 33, and 53, 54 and the combustion air flow rate become zero, and then control by the operation outputs valve 43 and controllers 61*a* and 61*b*.

Therefore, according to the construction as described above, the level of charbed 13 is controlled by both the temperature regulation control of the black liquor and the regulation control of the combustion air flow rate. Thus, the responsiveness for the variation of the charbed level is accelerated to improve the controllability. Further, even if the deviation is displaced out of the allowable range due to an external disturbance, the air flow rate is controlled rapidly by the regulation control of the combustion air flow rate to approach the charbed level to the original allowable range and hence the set value.

Figure 5:
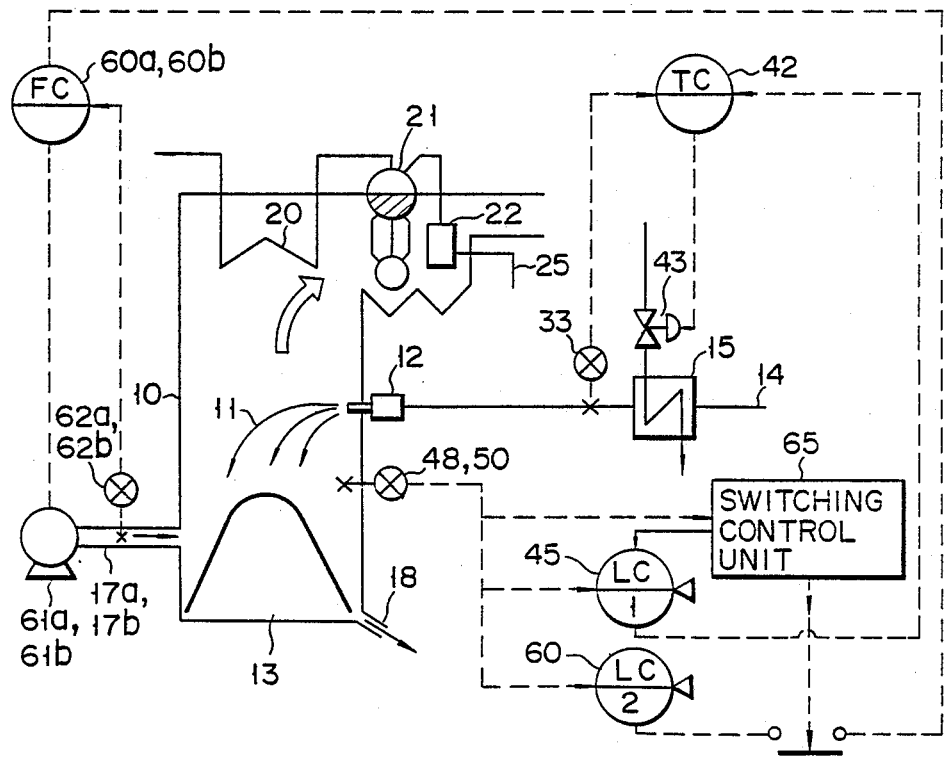
FIG. 5 is a block diagram of a concrete circuit of the case of controlling the black liquor temperature or air supply amount in response to a charbed level.

In the example described above, the black liquor temperature regulation control and the combustion air regulation control are simultaneously conducted. However, as shown, for example, in FIG. 5, a switching control circuit 65 provided at the output sides of regulators 45 and 60 may control thereby to additionally regulating the combustion air while the control operation of black liquor temperature regulation controller 42 is held by combustion air regulation controllers 61*a* and 61*b* in the following manner. When the deviation of the charbed levels detected by detectors 48 and 50 exceeds a predetermined level deviation, i.e., when the level deviation increases, the temperature of the black liquor is held at the instant value and air regulation will be additionally done. Therefore, even in this case both the regulation controls are employed, but may be suitably selectively used in response to the magnitude of the charbed level. More specifically, when the variation in the charbed level is less, the level is stably controlled only by the black liquor temperature regulation control, while when the variation in the level is more, the temperature control is held at a constant value and the combustion air regulation control is additionally used so as to rapidly return to the target value, thereby controlling the level. Thus, the level can be stabilized and hence the combustion state can be stabilized, and even if the variation in the level is large, the charbed can be rapidly and reliably led to a predetermined value.

Figure 6:
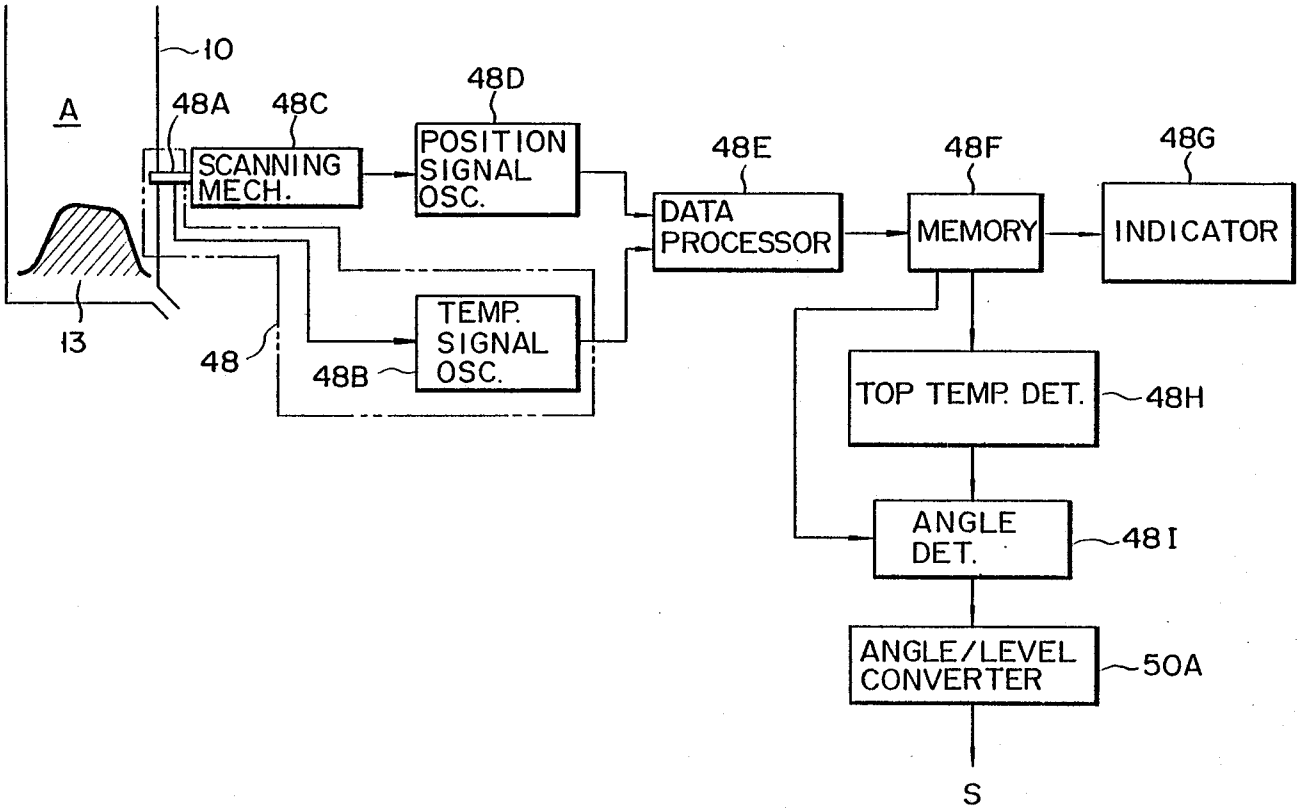
FIGS. 6 and 7 are block diagrams showing the construction of a temperature detector at the top of the charbed.

Radiation thermometer 48 shown in FIG. 1 has radiation energy detector 48A provided on the outer wall of boiler 10 as shown in FIG. 6, and temperature signal oscillator 48B for converting radiation energy intensity detected by detector 48A into temperature data to sequentially oscillate. Detector 48A detects the radiation energy within the visual point and is particularly set to have a sensitivity in a wavelength band which is hardly affected by the influence of the ration of gas in the boiler 10 so as to distinguish the radiation energy by charbed 13 and the radiation energy by the gas in the boiler.

A radiation energy detector or an image detection device shown in U.S. Pat. No. 4,539,588 may be used as the radiation energy detector 48A. FIG. 2 of U.S. Pat. No. 4,539,588 is a view showing a relationship between the measuring wavelength (abscissa axis) and extinction coefficient (ordinate axis) as the radiation energy intensity in gas and particles or charbed in the furnace. As apparent from FIG. 2, since the extinction coefficient of gas in the furnace decreases smaller than that of particles or charbed near the measuring wavelength 3.7 microns, when a detector having the far infrared measuring wavelength 3.7 microns is used, the detection can be conducted in the state hardly affected by the influence of gas.

In FIG. 6, detector 48A is provided to be able to scan in a sector type perpendicularly to charbed 13 by scanning mechanism 48C, the scanning angle of the visual point of detector 48A is detected by position signal oscillator 48D which sequentially oscillates angular data. Mechanism 48C may include means for scanning only the visual point of detector 48A in a sector shape, or means for scanning detector 48A itself along a rail provided perpendicularly.

On the other hand, temperature data oscillated from oscillator 48B and angular data oscillated from oscillator 48D are applied to data processor 48E. Processor 48E produces temperature data corresponding to the scanning angle of the visual point of detector 48A, the temperature data corresponding to the scanning angle is stored in sequential memory 48F, smoothed as required, and then displayed on an indicator 48G such as a CRT. Top temperature measuring unit 48H of charbed 13 measures the top temperature of charbed 13 in accordance with data stored in memory 48F, and produces an output to angle detector 48I. Detector 48I produces angle data corresponding to the top temperature of the charbed measured by measuring unit 48H from memory 48F, and angle data detected by detector 48I is converted by angle/level converter 50A into charbed level value and output as charbed level signal S.

Figure 7:
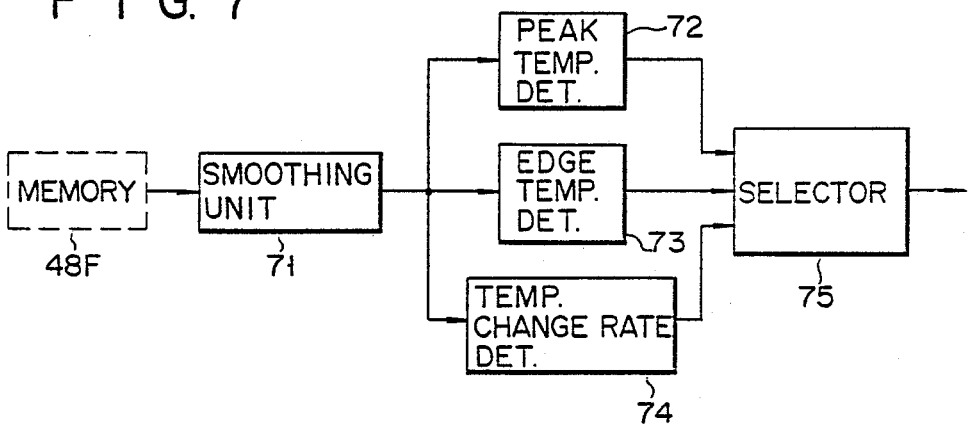
Figure 8:
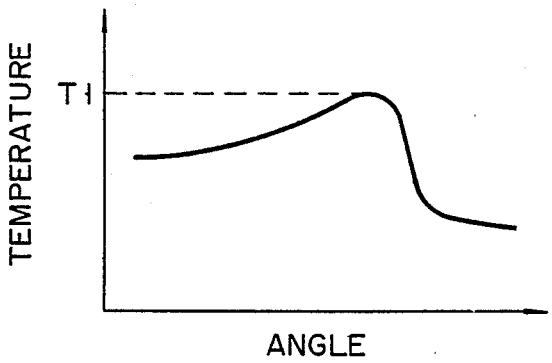
FIGS. 8 and 9 are graphs showing examples of the temperature data stored in a memory in FIG. 7.

FIG. 7 is a block diagram of the concrete arrangement of charbed top temperature measuring unit 48H. In FIG. 8, temperature data corresponding to the scanning angle of the visual point of detector 48A stored in memory 48F is smoothed by smoothing circuit 71, then output to peak temperature detector 72, an edge sample temperature detector 73, and temperature change rate detector 74, and the top temperature of charbed 13 is measured by detectors 72 to 74. Then, either one of charbed top temperature measured values measured by detectors 72 to 74 is selected by selector 75 and output.

Detector 72 sequentially compares temperature data stored in memory 48F, and outputs the maximum temperature data as charbed top temperature. The surface temperature of charbed 13 increases toward the upper portion. Therefore, when detector 48A scans perpendicularly with respect to charbed 13, the detected temperature along one scanning line gradually rises as shown in FIG. 8, and when the visual point of detector 48A is displaced out of charbed 13, the wavelength band of detector 48A is set to the wavelength band which is hardly affected by the influence of the radiation of gas in the furnace. Thus, the detecting temperature abruptly drops. Therefore, peak temperature T1 of temperature data stored in memory 48F is generally considered to be the top temperature of charbed 13.

Figure 9:
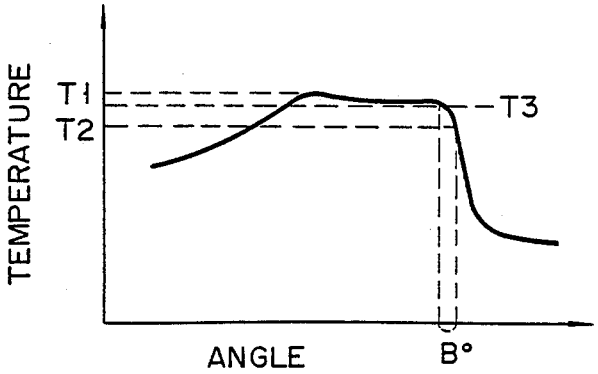

However, when the combustion state becomes locally vigorous in the middle portion of charbed 13, this portion becomes the highest temperature. At this time, temperature data stored in memory 48F becomes as shown in FIG. 9, and peak temperature T1 does not become the top temperature of charbed 13. In this case, detector 73 detects the edge sample temperature, and outputs it as the top temperature of charbed 13. In other words, detector 73 holds peak temperature T1 from temperature data stored in memory 48F, multiplies peak temperature T1 by preset predetermined ratio $\alpha$ $(40<\alpha<100)$ % to produce slice level temperature T2, and detects the temperature of the angle lower by preset predetermined angle $\beta°$ than the angle corresponding to temperature T2, so-called edge sample temperature T3 as charbed top temperature.

On the other hand, since detector 48A has a sensitivity in the wavelength band which is hardly affected by the influence of the radiation of gas in the furnace as described, when the visual point is scanned in a perpendicular direction with respect to charbed 13, the detected temperature abruptly drops at the time when the visual point is displaced out of charbed 13. Then, detector 74 calculates the change rate of temperature data stored in memory 48F, and outputs the higher temperature when the negative temperature change rate becomes maximum as the charbed top temperature.

In the apparatus constructed as described above, detector 48A is scanned perpendicularly with respect to charbed 13 by mechanism 48C. Then, the temperature data with respect to the scanning angle of the visual point of detector 48A is stored in memory 48F, and indicated on indicator 48G. An operator observes the temperature data displayed on indicator 48G judges whether the temperature detected by any of detectors 72, 73, and 74 is adequate or not as charbed top temperature, and selects by selector 75. More particularly, the temperature data indicated on indicator 48G gradually rises as the scanning angle increases as shown in FIG. 8. When data which abruptly falls at a predetermined angle is obtained, the temperature detected by detector 72 is output as charbed top temperature.

On the other hand, when the temperature data has a projection as shown in FIG. 9, the temperature detected by detector 73 or 74 is output as charbed top temperature. In this case, if the temperature data abruptly drops when the visual point of detector 48A is displaced out of charbed 13, the temperature detected by detector 73 does not have any error as the charbed top temperature, but when the slope of the drop of the temperature data is smooth, the temperature detected by detector 73 tends to produce an error. Thus, the temperature detector by detector 74 is desired as the charbed top temperature.

Thus, when the charbed top temperature is detected by selector 75, the angle data corresponding to the top temperature is loaded by detector 48I from memory 48F. Then, converter 50A converts the angle data into charbed level value.

Figure 10:
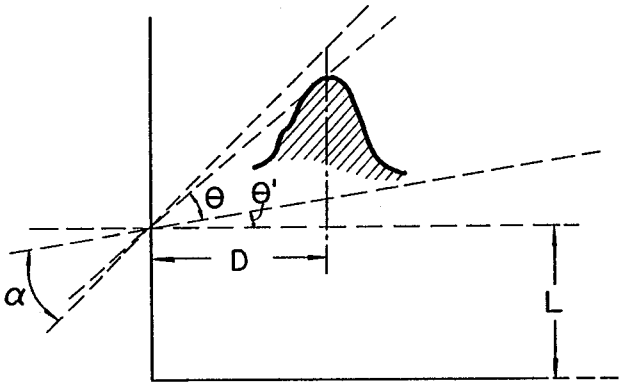
FIG. 10 is a view showing an example of converting angular data into a charbed level value.

FIG. 10 is a view showing an example of converting means 50A for converting angle data into charbed level value. In FIG. 10, reference character $\theta$ designates the output angle of detector 48A, character $\theta'$ designates a horizontal angle regulating parameter of detector 48A, character L designates the height of the mounting position of detector 48A on the wall surface of the oven from the bottom of boiler 10, and character D designates a distance to the measuring angle. Thus, charbed level value H is obtained by the following equation:

$$H=L+D\tan(\theta+\theta')°$$

As described above, the charbed temperature and the charbed level can be simply and accurately measured merely by scanning detector 48A having a sensitivity in the wavelength which is hardly affected by the influence of the radiation of gas A in the furnace perpendicularly with respect to charbed 13. Therefore, the temperature of injected black liquor injected into boiler 10 is regulated in accordance with the measured charbed level value to control so that the charbed level becomes constant, thereby stably and efficiently operating the recovery boiler.

The temperature output produced from measuring unit 48H of FIG. 6 is used as the output of calculator 49 of FIG. 1, added to adder 76, and the temperature of black liquor 13 may be compensated by the top temperature of charbed 13. The output of adder 76 is applied to adder 52.

In FIG. 7, a predetermined temperature data pattern is stored in advance in the memory, the temperature data pattern is compared by the temperature data stored in memory 48F to judge whether the output of any of detectors 72 to 74 is adequate or not, and the selected output of selector 75 may be automatically converted. Further, the temperature is detected by at least one of detectors 72 to 74, and the temperature may be output as the charbed top temperature. Moreover, detector 74 calculates the sequential temperature change rates in accordance with the scanning direction of the visual point of detector 48A, additionally calculates the sequential temperature change rates from reverse direction with respect to the scanning direction, and may output higher temperature as the charbed top temperature when the positive temperature change rate becomes maximum. In the embodiment described above, the case that the black liquor temperature is regulated according to charbed level signal S to control that the charbed level becomes constant has been described. However, the charbed level may be controlled constantly by regulating the combustion air flow rate supplied into the recovery boiler.

Figure 12A:
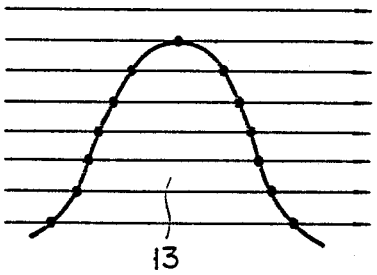
FIGS. 12A and 12B are views showing the state of scanning the charbed by a characteristic measuring instrument.
Figure 12B:
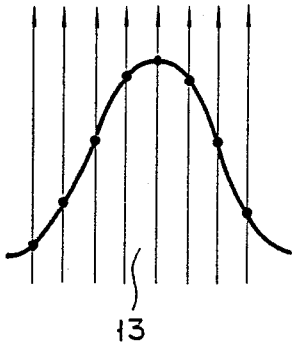

Further, detector 48A may employ that capable of planar scanning the visual point in the horizontal direction as shown in FIG. 12A or in the vertical direction as shown in FIG. 12B by mechanism 48C. The scanning position of the visual point of detector 48A is detected by oscillator 48D to sequentially oscillate as position data.

Figure 11:
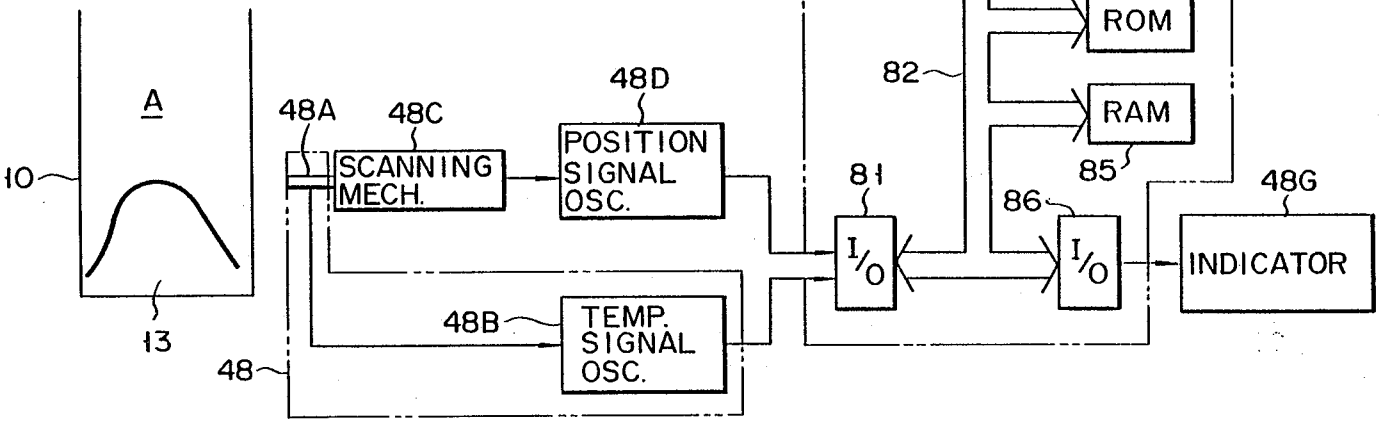
FIG. 11 is a block diagram showing the construction of controlling displaying two-dimensionally a charbed level by the level data and temperature data obtained by the conversion.

On the other hand, the temperature data output from oscillator 48B and the position data output from oscillator 48D are input, as shown in FIG. 11, by input/output interface 81 into microcomputer 48F', and fed through data bus 82 to CPU 83. CPU 83 processes data in accordance with the processing program stored in advance in program ROM 84, stores, as required, the data processing result in RAM 85 to produce the twodimensional shape and the surface temperature distribution of charbed 13 as shown in FIGS. 12A, 12B, which may be constructed to display through input/output interface 86 on two-dimensional indicator 48G.

According to the embodiment described above, the shape or surface temperature distribution of charbed 13 is automatically and accurately indicated on indicator 48G. Therefore, it is not necessary to monitor the charbed shape with ones eyes from an observation window of boiler 10 as in the conventional apparatus. For example, when indicator 48G is mounted in an operation room, an operator can monitor indicator 48G to readily and rapidly determine the shape of charbed 13. As a result, if the shape of charbed 13 becomes improper, the recovery process can be rapidly conducted.

Figure 13:
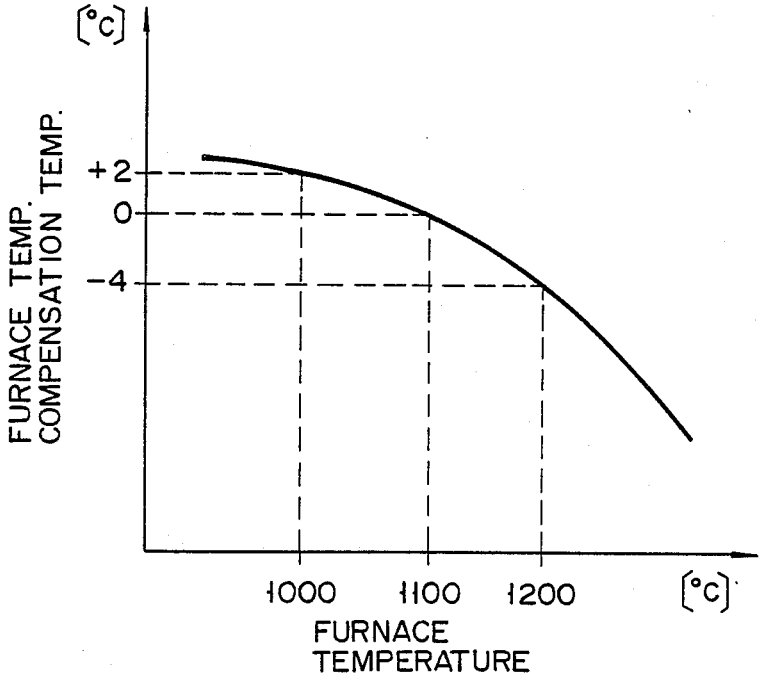
FIG. 13 is a graph showing a relationship between the temperature in the boiler and the black liquor temperature compensation value.

FIG. 13 is a view showing a relationship between the temperature in the furnace and the temperature compensation value in the oven. In case of normal furnace temperature, i.e., the temperature reference value P in the oven, the temperature compensation value in the oven is set to 0° C. When the temperature in the oven rises, the drying time of droplet is shortened. Thus, calculator 76 in FIG. 1 calculates the temperature compensation value in the oven to reduce the black liquor temperature set value calculated by adder 39. When the temperature in the oven, on the contrary, falls, the calculator 76 calculates the temperature compensation value in the oven to raise the black liquor temperature set value.

As described above, the temperature compensation value in the oven according to a relationship between the temperature in the oven and the diameter of droplet in response to the variation in the temperature in the oven of boiler 10 is calculated, and the black liquor temperature set value may be compensated by the temperature compensation value in the oven. Therefore, the variation in the black liquor temperature set value may be simply compensated by the variation in the temperature in the oven, and the temperature of injecting black liquor 11 may be set to always obtain the optimum diameter of a droplet. As a result, boiler 10 is always operated in the optimum combustion state, thereby saving and stabilizing the pulp production process.

In FIG. 1, sulfur dioxide $SO_2$ gas contained in exhaust gas from chimney 19 is detected by sulfur dioxide $SO_2$ detector 90, the detected data is supplied to a calculator 91, which calculates the black liquor temperature compensation value responsive to the sulfur dioxide concentration. This compensation value is supplied to adder 57 to compensate the set temperature of regulator 42, and the black liquor temperature is so controlled as to reduce the sulfur dioxide $SO_2$.

Figure 14:
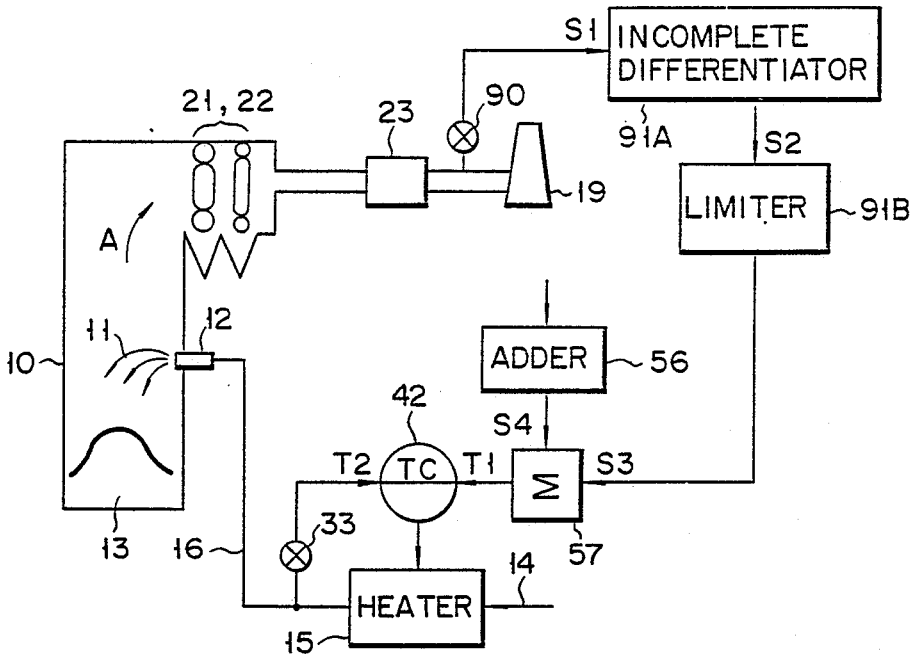
FIG. 14 is a block diagram of a circuit for controlling the injected black liquor in response to the concentration by detecting the sulfur dioxide $SO_2$ contained in the exhaust gas from the boiler.

An example of calculator 91 is shown in FIG. 14. Here, the output of sensor 90 is differentiated by an incomplete differentiator 91A, the output of which is applied to limiter 91B. When the sulfur dioxide concentration rises, differentiator 91A outputs positive incomplete differentiated output and oscillates negative incomplete differentiation signal when the concentration falls. Limiter 91B cuts when an incomplete differentiation signal S2 is negative, oscillates an output proportional to an input level when the signal is positive to be the upper limit value or lower, oscillates a constant output irrespective of the input level when exceeding the upper limit value to supply as black liquor temperature correction signal S3 to one input terminal of an adder 57, and a signal S4 from adder 56 is supplied to the other input terminal of adder 57. Adder 57 adds signal S3 to signal S4 to compensate the black liquor temperature set value and outputs as black liquor target temperature T1 to black liquor temperature regulator 42.

In the apparatus thus constructed as described above, the sulfur dioxide $SO_2$ concentration in the combustion exhaust gas is always detected by detector 90. When the concentration drops, calculator 91A outputs negative incomplete differentiation signal S2. However, since signal S2 is cut by limiter 91B, signal S3 is not oscillated, and injecting black liquor temperature T2 does not change.

On the other hand, when the sulfur dioxide concentration in the combustion exhaust gas rises, calculator 91A outputs positive incomplete differentiation signal S2. Thus, limiter 91B outputs black liquid temperature compensation signal S3 to increase the injecting black liquor temperature T2 in response to signal S2, and adder 57 adds signal S4 to calculate black liquor target temperature T1. Then, the heat amount of heater 15 is controlled to be fed back by regulator 42 so that temperature T2 becomes temperature T1. Temperature T2 is maintained slightly lower than the boiling point of black liquor 11, and temperature T2 may not become the boiling point or higher. Thus, the upper limit is provided in the black liquor temperature compensation value by limiter 91B to eliminate the excessive compensation.

Figure 15:
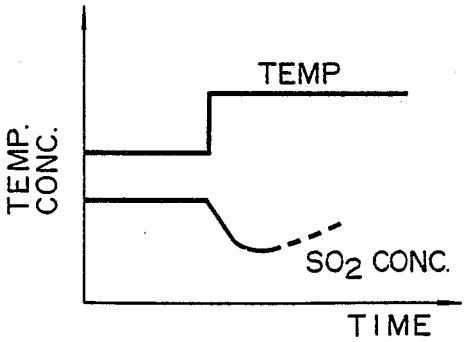
FIG. 15 is a graph showing the state of varying the concentration of the sulfur dioxide with respect to the step change of the injected black liquor temperature as a time is elapsed.

Temperature T2 and the sulfur dioxide concentration in the combustion exhaust gas have a trend to reduce the concentration when temperature T2 rises therebetween transiently as shown in FIG. 15.

Therefore, according to the embodiment described above, when the sulfur dioxide concentration in the combustion exhaust gas rises, the compensation for rising the injecting black liquor temperature set value is performed to calculate black liquor target temperature, and heater 15 is controlled so that temperature T2 coincides with temperature T2 to rise the temperature of injecting black liquor 11. Accordingly, as apparent from FIG. 15, the rise of the sulfur dioxide concentration in the combustion exhaust gas can be transiently suppressed.

On the other hand, it is discovered that there is the injecting black liquor temperature that the sulfur dioxide concentration becomes minimum as shown in FIG. 17 in a long period between the injecting black liquor temperature and the sulfur dioxide concentration. Thus, it is possible to maintain the sulfur dioxide concentration in the minimum state by searching the extreme values by a climbing method of known algorithm, discovering and holding the optimum injecting black liquor temperature.

FIG. 16 is a systematic view showing the construction of the apparatus using the extreme value searching method. The different point of this embodiment from the previous embodiment in FIG. 16 is that an extreme search unit 95 is provided instead of calculator 91A and limiter 91B, the other portions are the same as those in FIG. 14, the same reference numerals as in the previous embodiment denote the same parts in this embodiment, and the detailed description thereof will be omitted.

Search unit 95 operates, for example, as below. Unit 95 first inputs injecting black liquor temperature T2 detected by detector 33, and outputs black liquor temperature compensation signal S3 to rise temperature T3 by predetermined temperature $\Delta T$ to adder 57. Then, temperature T2 rises by temperature $\Delta T$, and the sulfur dioxide concentration thus varies. When the concentration decreases at this time, signal S3 to rise the temperature T2 is again output, while when the concentration rises, signal S3 to fall the temperature T2 is output. Then, the concentration is again examined. This operation is then repeated to discover temperature T2 so that the concentration becomes minimum in a climbing manner, and the value is maintained.

According to the embodiment as described above, temperature T2 that the sulfur dioxide concentration becomes minimum is discovered by the climbing method, and the value is maintained. Accordingly, the sulfur dioxide concentration contained in the combustion exhaust gas is controlled to always become the minimum value. Therefore, since the concentration can be suppressed to considerably low level as compared with the restricted value, the boiler can be much more stably operated. Further, when an external disturbance is introduced or a plant state varies, the optimum injecting black liquor temperature varies, but in this case the extreme value searching is again conducted to obtain the optimum temperature responsive to the state to always control stably the sulfur dioxide concentration.

The present invention is not limited to the particular embodiments described above. For example, in the second embodiment, the injecting black liquor temperature T2 that the sulfur dioxide concentration becomes minimum is discovered by a climbing method as the extreme value search unit. However, data of a plurality of injecting black liquor temperatures T2 and the sulfur dioxide concentrations corresponding to the temperatures are obtained, the function of the sulfur dioxide concentrations for the temperatures T2 is calculated from the data by the minimum squaring method, and the variable value (the injecting black liquor temperature) that the function values (the sulfur dioxide concentration) becomes minimum may be obtained and output.

Referring to FIGS. 16, 17, and 18, the construction and the operation of an example of an extreme value search unit will be described. The output of sulfur dioxide $SO_2$ sensor 90 is sampled through a sampling circuit 100 as predetermined, and supplied directly to the input terminal of a comparison circuit 101 and through a delay circuit 102. Thus, whether the sulfur dioxide concentration of the sampled value a at this time is higher than the sampled value b at previous time or not can be identified by the sign of the output (a−b) of the comparison circuit 101. This relationship is shown in FIG. 18. For example, as shown in FIG. 17, even if the sulfur dioxide $SO_2$ is 500 PPM, it is necessary to rise the temperature when the sign of (a−b) is positive in the left side at 120° C. as a center, and to fall the temperature when the sign is positive in the right side. In other words, as a result of comparison of the temperature set value applied at the previous time to memory 103 through adder 104 from temperature regulator 105 with that at this time, if it is higher than 120° C., it is controlled to fall the temperature, while if lower, it is controlled to rise the temperature.

The initially set temperature of the black liquor may be determined by adding a compensation value to a reference temperature.

What is claimed is:

1. An apparatus for controlling operation of a recovery of a recovery boiler, comprising:

means for controlling a predetermined temperature of black liquor for obtaining a predetermined size of droplets of the black liquor injected into the boiler;

means for producing at least one of a compensation value set by an injecting gun provided in the boiler, a compensation value set by the properties of the black liquor, a compensation value set by the temperature of a furnace of the boiler, a compensation value set by the magnitude of boiler load and a compensation value set by an amount of exhausted SO to control the black liquor temperature supplied to the boiler;

means for compensating a predetermined reference temperature of the black liquor by the output of said means to control black liquor temperature supplied to the boiler;

boiling point presuming means for presuming the boiling point of the black liquor in response to the concentration of the black liquor injected into the boiler and the black liquor properties obtained in accordance with the types and the introducing amounts of a chip material introduced in chip cooking step and chip cooking reagent; and black liquor temperature setting means for calculating the set temperature of the black liquor in accordance with the boiling point presumed by said boiling presuming means.

2. An apparatus for controlling operation of a recovery of a recovery boiler, comprising:

means for controlling a predetermined temperature of black liquor for obtaining a predetermined size of droplets of the black liquor injected into the boiler;

means for producing at least one of a compensation value set by an injecting gun provided in the boiler, a compensation value set by the properties of the black liquor, a compensation value set by the temperature of a furnace of the boiler, a compensation value set by the magnitude of boiler load and a compensation value set by an amount of exhausted SO to control the black liquor temperature supplied to the boiler;

means for compensating a predetermined reference temperature of the black liquor by the output of said means to control black liquor temperature supplied to the boiler;

boiling point presuming means for presuming the boiling point of the black liquor in response to the concentration of the black liquor injected into the boiler;

black liquor temperature setting means for calculating the set temperature of the black liquor in accordance with the boiling point presumed by said boiling point presuming means;

injecting pressure detecting means for detecting the injecting pressure of a black liquor injecting mechanism for injecting the black liquor into the boiler;

black liquor injecting mechanism setting means for setting the properties of said black liquor injecting mechanism; and set temperature compensating means for compensating the set temperature calculated by said black liquor temperature setting means in accordance with the properties of the black liquor injecting mechanism set by said black liquor injecting mechanism setting means and the injecting pressure detected by said injecting pressure detecting means.

3. An apparatus for controlling operation of a recovery boiler, comprising:

means for controlling a predetermined temperature of black liquor for obtaining a predetermined size of droplets of the black liquor injected into the boiler;

means for producing at least one of a compensation value set by an injecting gun provided in the boiler, a compensation value set by the properties of the black liquor, a compensation value set by the temperature of a furnace of the boiler, a compensation value set by the magnitude of boiler load and a compensation value set by an amount of exhausted $SO_2$ to control the black liquor temperature supplied to the boiler;

means for compensating a predetermined reference temperature of the black liquor by the output of said means to control black liquor temperature supplied to the boiler;

boiling point presuming means for presuming the boiling point of the black liquor in response to the concentration of the black liquor injected into the boiler;

black liquor temperature setting means for calculating the set temperature of the black liquor in accordance with the boiling point presumed by said boiling point presuming means;

load data detecting means for detecting data representing the magnitude of the load of the boiler; and set temperature compensating means for compensating the set temperature calculated by said black liquor temperature setting means in accordance with the data detected by said load data detecting means.

4. An apparatus according to claim 3, wherein said load data detecting means detects combustion air flow rate supplied to the boiler.

5. An apparatus for controlling operation of a recovery boiler, comprising:

means for controlling a predetermined temperature of black liquor for obtaining a predetermined size of droplets of the black liquor injected into the boiler;

means for producing at least one of a compensation value set by an injecting gun provided in the boiler, a compensation value set by the properties of the black liquor, a compensation value set by the temperature of a furnace of the boiler, a compensation value set by the magnitude of boiler load and a compensation value set by an amount of exhausted $SO_2$ to control the black liquor temperature supplied to the boiler;

means for compensating a predetermined reference temperature of the black liquor by the output of said means to control black liquor temperature supplied to the boiler;

a radiation thermometer having a sensitivity in a wavelength band hardly affected by the influence of the radiation of gas in the boiler provided on a wall of the furnace of the boiler;

a scanning mechanism for scanning a visual point of the thermometer in a perpendicular direction with respect to the charbed; and top temperature measuring means for measuring the top temperature of the charbed in accordance with the radiation energy intensity distribution along the scanning line of the thermometer scanned by said scanning mechanism.

6. An apparatus for controlling operation of a recovery boiler, comprising:

means for controlling a predetermined temperature of black liquor for obtaining a predetermined size of droplets of the black liquor injected into the boiler;

means for producing at least one of a compensation value set by an injecting gun provided in the boiler, a compensation value set by the properties of the black liquor, a compensation value set by the temperature of a furnace of the boiler, a compensation value set by the magnitude of boiler load and a compensation value set by an amount of exhausted $SO_2$ to control the black liquor temperature supplied to the boiler;

means for compensating a predetermined reference temperature of the black liquor by the output of said means to control black liquor temperature supplied to the boiler;

boiling point presuming means for presuming the boiling point of the black liquor in response to the concentration of the black liquor injected into the boiler;

black liquor temperature setting means for calculating the set temperature of the black liquor in accordance with the boiling point presumed by said boiling point presuming means;

furnace temperature detecting means for detecting the temperature in the furnace of the boiler; and set temperature compensating means for compensating the set temperature calculated by said black liquor temperature setting means in accordance with the temperature in the furnace detected by said furnace temperature detecting means.

* * * * *